US007717426B1

(12) United States Patent
Malmloff et al.

(10) Patent No.: US 7,717,426 B1
(45) Date of Patent: May 18, 2010

(54) SELF-CONTAINED DICE TUMBLER

(75) Inventors: Craig Malmloff, Fishers, IN (US); Tony Martin, Indianapolis, IN (US); Michael Murphy, Danville, IN (US)

(73) Assignee: Fundex Games, Ltd., Indianapolis, IN (US)

( * ) Notice: Subject to any disclaimer, the term of this patent is extended or adjusted under 35 U.S.C. 154(b) by 37 days.

(21) Appl. No.: 12/329,701

(22) Filed: Dec. 8, 2008

(51) Int. Cl.
*A63F 9/04* (2006.01)

(52) U.S. Cl. ..... 273/145 B; 273/145 R; D21/372

(58) Field of Classification Search ..... 273/145 B, 273/145 R, 145 C, 145 CA; D21/372
See application file for complete search history.

(56) References Cited

U.S. PATENT DOCUMENTS

| | | | | |
|---|---|---|---|---|
| 2,241,567 | A | | 5/1941 | Wobensmith |
| D144,155 | S | * | 3/1946 | Kastner ..... D21/372 |
| 3,468,543 | A | | 9/1969 | Dove |
| D245,933 | S | * | 9/1977 | Blum ..... D21/372 |
| D248,053 | S | * | 5/1978 | Jacobs et al. ..... D21/372 |
| 4,094,509 | A | * | 6/1978 | Barron ..... 273/247 |
| 4,095,796 | A | | 6/1978 | Monson |
| D268,504 | S | | 4/1983 | Noga |
| D269,287 | S | * | 6/1983 | Gray ..... D21/372 |
| 4,534,559 | A | | 8/1985 | Laursen, Jr. |
| 4,805,908 | A | | 2/1989 | Auclair et al. |
| 4,807,883 | A | | 2/1989 | Silverman |
| 4,893,816 | A | | 1/1990 | Levy et al. |
| 4,930,780 | A | | 6/1990 | Goodman et al. |
| 4,984,797 | A | | 1/1991 | Norsworthy |
| 5,082,288 | A | | 1/1992 | Swartz |
| 5,100,141 | A | | 3/1992 | Fitch |
| D341,385 | S | | 11/1993 | Fitch |
| D361,096 | S | * | 8/1995 | Shenk et al. ..... D21/372 |
| 5,456,467 | A | | 10/1995 | Hoover |
| D365,126 | S | * | 12/1995 | Kirk ..... D21/372 |
| 6,402,141 | B1 | | 6/2002 | Verstraeten |

* cited by examiner

*Primary Examiner*—Benjamin H Layno
(74) *Attorney, Agent, or Firm*—Adam K. Sacharoff; Much Shelist

(57) ABSTRACT

In one embodiment there is provided a self contained dice tumbler device. The device includes an interior lateral panel positioned within the interior of the device and which separates the interior into a tumbler compartment and a holding compartment. The holding compartment can be used to store playing cards. The device also includes at least one ramp in the tumbler compartment that leads to an exit opening. Dice dropped into the tumbler compartment can get scrambled and will slide out of the exit opening. The cover the top and exit opening on the device, a hinged panel door is included. The hinged panel door has a rear panel to cover the exit opening and a top panel to cover the top of the device.

17 Claims, 10 Drawing Sheets

SELF-CONTAINED DICE TUMBLER

FIELD OF THE INVENTION

The invention relates to a self-contained device designed to tumble dice and like objects, which can also be used to securely contain the dice and other items for storage and shipping purposes.

BACKGROUND OF THE INVENTION

Many games utilize dice or other three-dimensional objects bearing indicia on adjacent surfaces. Both board games and non-board games require players to roll dice to play the games. Customarily, the dice are rolled by the player taking his turn by simply throwing them on to the board or a suitable horizontal surface. In most instances the games require a player to shake the dice in a player's hand and then throw the dice, while in some instances the games include a cup for scrambling and throwing the dice. In an effort to provide a uniform manner in shaking or agitating the dice, dice shakers have been developed, such as illustrated in U.S. Pat. Nos. 5,082,288, 5,100,141, 3,468,543, and D341,385.

However, these tend to have complex constructions and are limited in the ability to provide a more compact manner in storing not only dice but other game playing items, such as playing cards and chips. As a result, there is a continual need to improve upon the prior art.

SUMMARY OF THE INVENTION

In one embodiment there is provided a self contained dice tumbler device. The device includes a housing having a front panel, a pair of side panels, a back panel, and a bottom panel. The front, side, and back panels all terminate at a top edge to define a hollow interior. An interior lateral panel is positioned within the hollow interior between the front and back panel and extending to connect to the pair of side panels. The interior lateral panel terminates at one end about the top edge and terminates at a bottom edge to a base member that is positioned above the bottom panel and connects to the back panel. A holding compartment is thus defined between the back panel and the interior panel, between the two side panels, and above the base member to the top edge and a tumbler compartment is defined between the front panel and the interior panel and between the two side panels. The tumbler compartment is opened about the top edge to provide access to the hollow interior and has a lower ramp member extending from the front panel downwardly towards the back panel and extending below the base member to an exit opening positioned along a lower area defined in the back panel. The device further includes a panel door having a rear panel and a top panel. The rear panel is hingedly attached to a bottom edge of the back panel below the exit opening and the real panel is hingedly attached to the top panel. The panel door when in a closed position positions the real panel against the back panel and positions the top panel against the top edge of the housing.

In other embodiments of the invention, the rear panel further includes side doors extending from either side edge of the rear panel, and wherein when the panel door is in the closed position, the side doors position against a portion of the side panels. In yet other aspects of the embodiments, each of the side doors include a notch corresponding to a detent on the side panels.

In yet other embodiment, the base member further includes an aperture opening onto a portion of the lower ramp member that traverses below the holding compartment. Thus any dice dropped into the holding compartment will travel through the aperture onto the lower ramp and exit the device.

In addition to the above, the tumbler compartment may include an upper ramp member above the lower ramp member, the upper ramp member extending downwardly and away from the front panel towards the interior panel, and the upper ramp member terminating at an edge positioned between the front panel and the interior panel. Yet further, the tumbler compartment may includes a middle ramp member positioned between the first ramp member and the lower ramp member, the middle ramp member extending downwardly and away from the interior panel towards the front panel, and the middle ramp member terminating at an edge positioned between the interior panel and the front panel.

In yet other embodiments, the interior panel includes a notch and the back panel includes sloping recessed section extending downwardly at a taper from the two side panels, whereby playing cards positioned in the holding compartment are accessible. The holding compartment may further include ribs positioned on each of the pair of side panels between the interior panel and the back panel. Each rib has a back portion positioned against one of the side panels and has a bottom portion positioned against the base member.

In other embodiments, the top panel of the panel door includes an inside surface with a protruding member having a defined profile that includes opposing side regions and opposing front and back regions that when the panel door is in the closed position, the protruding member frictionally fits into a top portion of the tumbler compartment.

In yet still other embodiments, the housing is defined as a two piece housing, wherein one of the two piece housing includes various lateral extending elements that are positioned between pairs of lateral segments on the other one of the two piece housing that abut the extending elements when the two piece housing is assembled.

In yet another embodiment, there is provided a self contained dice tumbler device. The device includes a housing defining a hollow interior and a top entry opening and an interior lateral panel positioned within the hollow interior to separate the hollow interior into a tumbler compartment and a holding compartment, the holding compartment having a defined bottom base member, and the tumbler compartment includes a lower ramp member extending below the bottom base member of the holding compartment to an exit opening positioned along a lower area in the housing, the bottom base member further including an aperture opening onto a portion of the lower ramp, and a panel door having a rear panel and a top panel, the rear panel being hingedly attached to a bottom edge of the lower area in the housing below the exit opening and the real panel being hingedly attached to the top panel, the panel door when in a closed position positions the real panel against a side of the housing sealing the exit opening and positions the top panel against the top entry opening of the housing.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF EMBODIMENTS OF THE INVENTION

Figure 1:
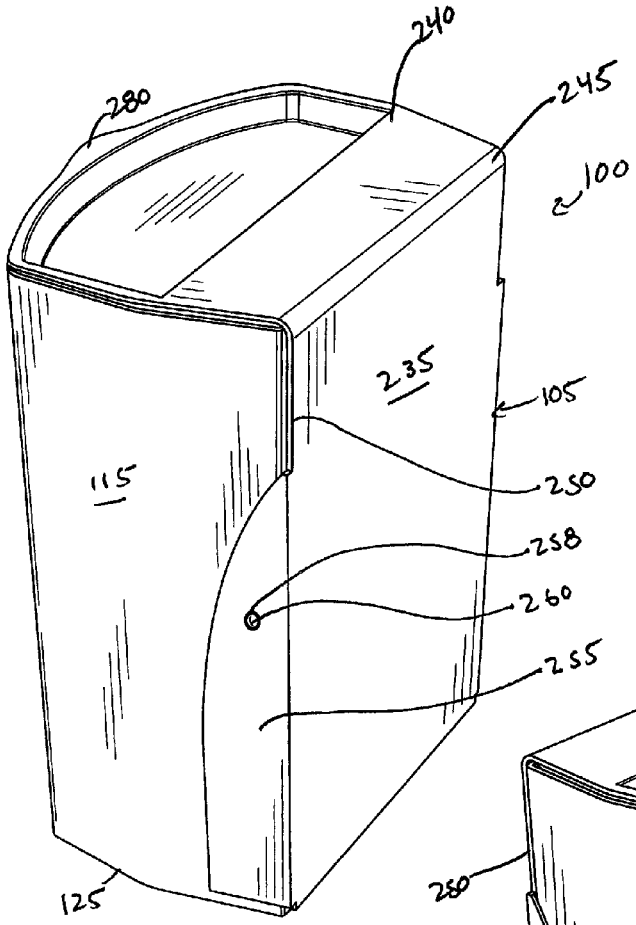
FIG. 1 is rear perspective view of a self contained dice tumbler device in accordance with an embodiment of the invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
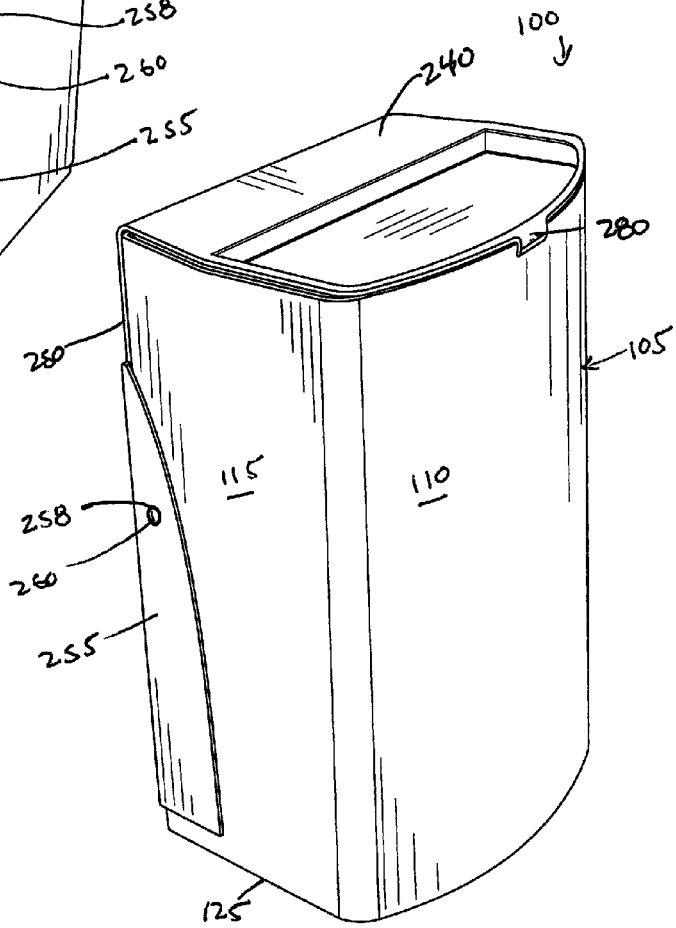
FIG. 2 is a front perspective view of FIG. 1.
Figure 3:
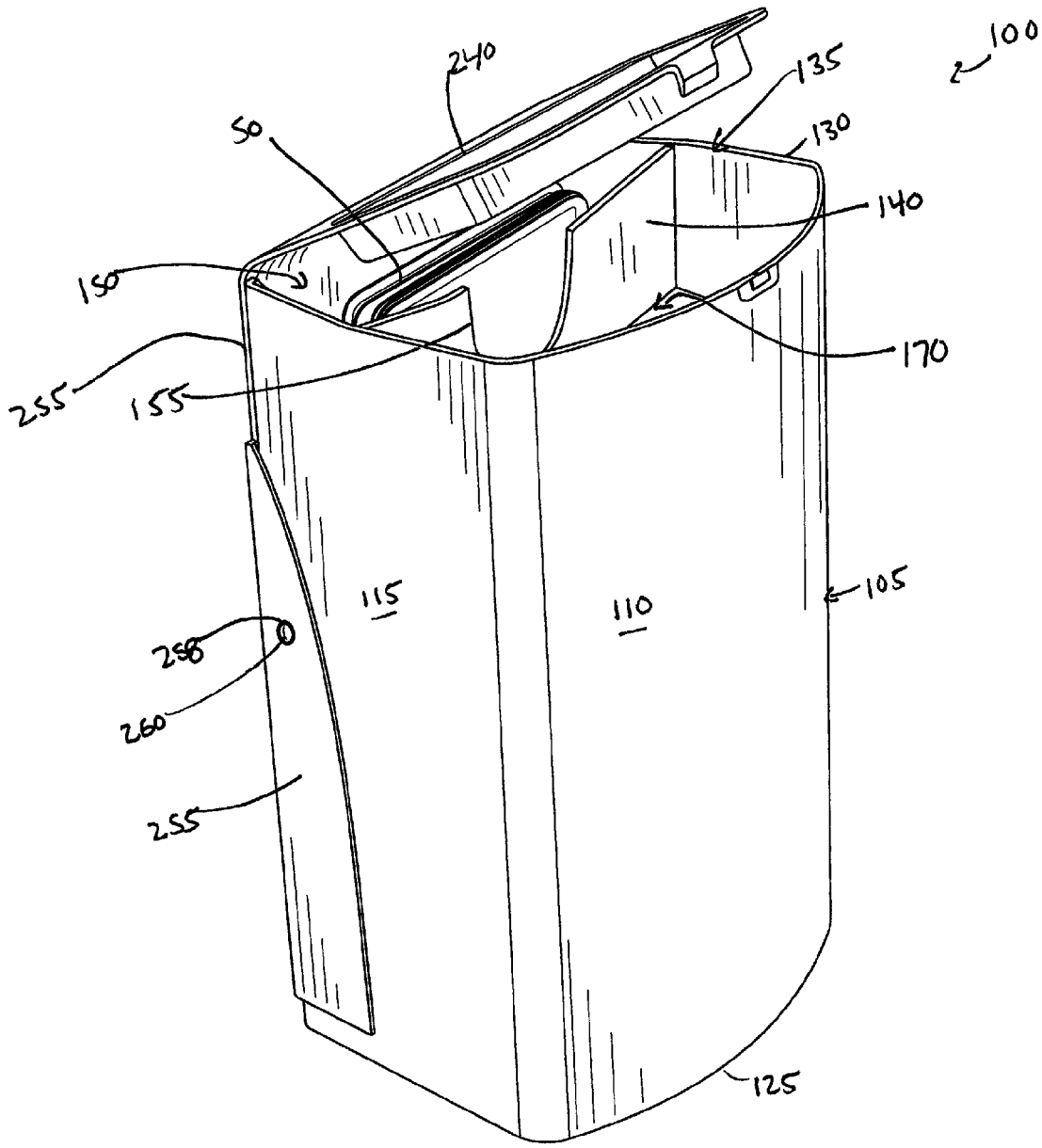
FIG. 3 is a front perspective view of FIG. 2 with the lid partially opening.
Figure 4:
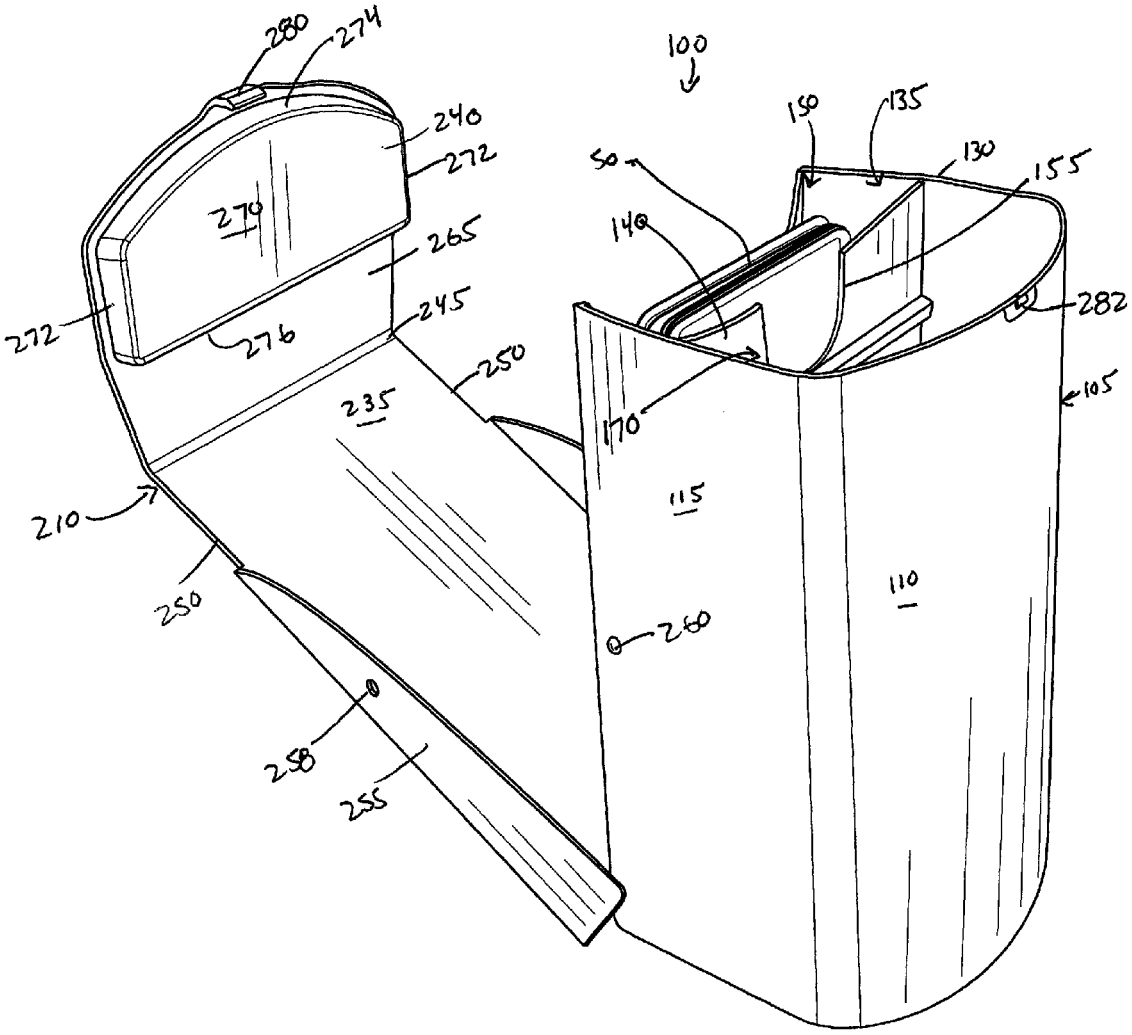
FIG. 4 is a front perspective view of FIG. 2 with the lid and rear panel opening.
Figure 5:
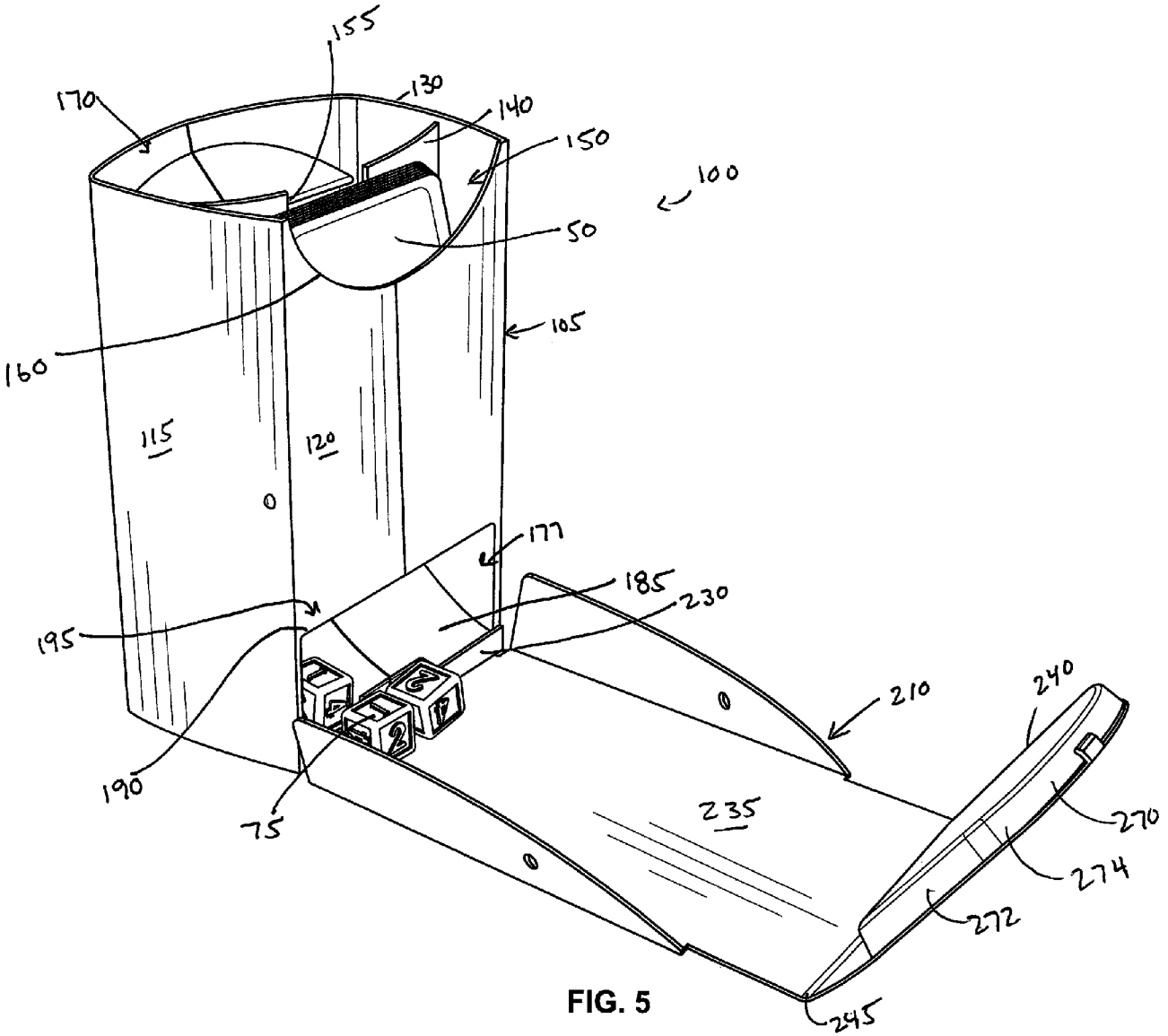
FIG. 5 is a rear perspective view of FIG. 2 with the lid and rear panel in the opened position.
Figure 6:
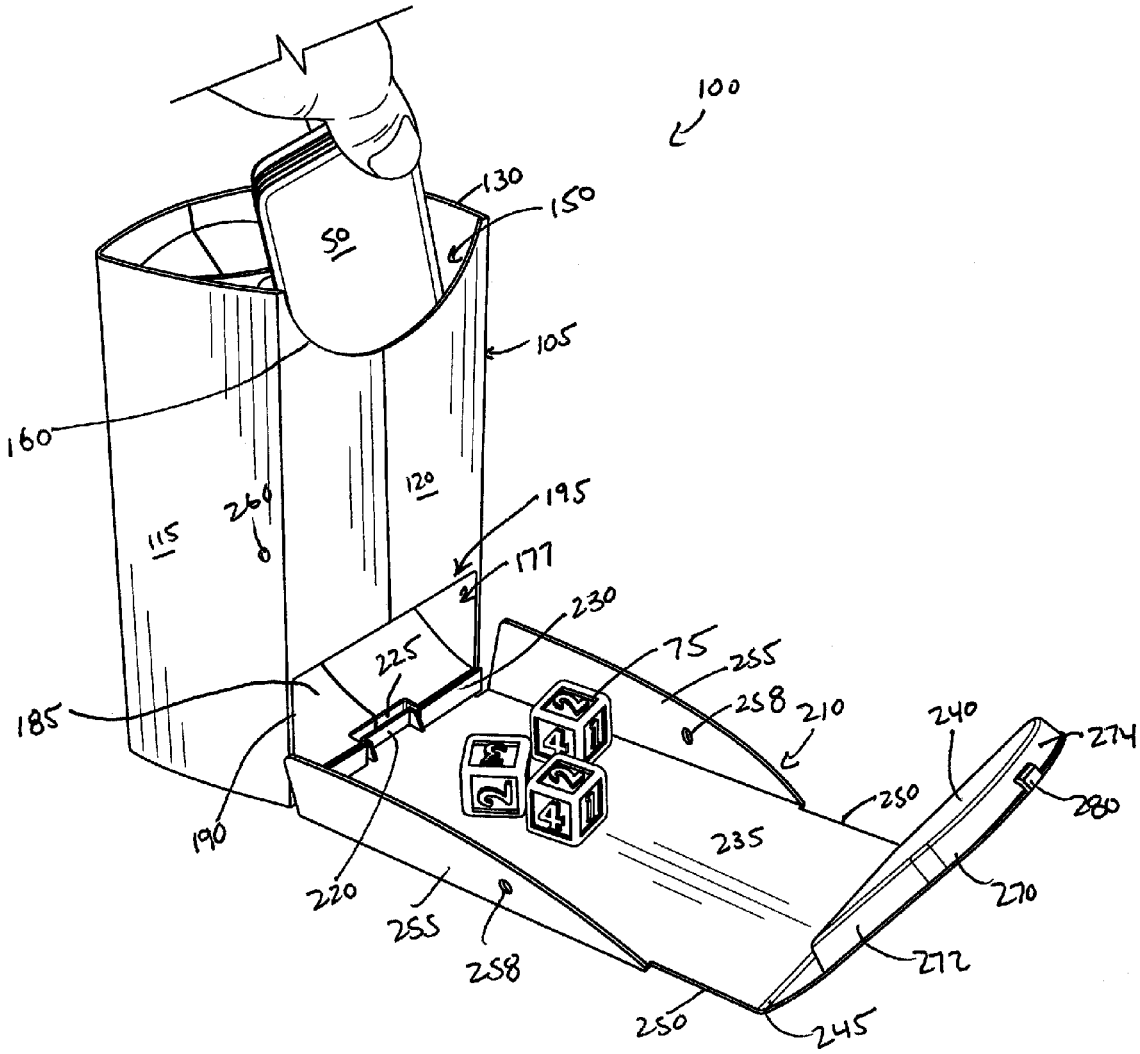
FIG. 6 is a rear perspective view of FIG. 5 showing dice and playing cards being removed.
Figure 7:
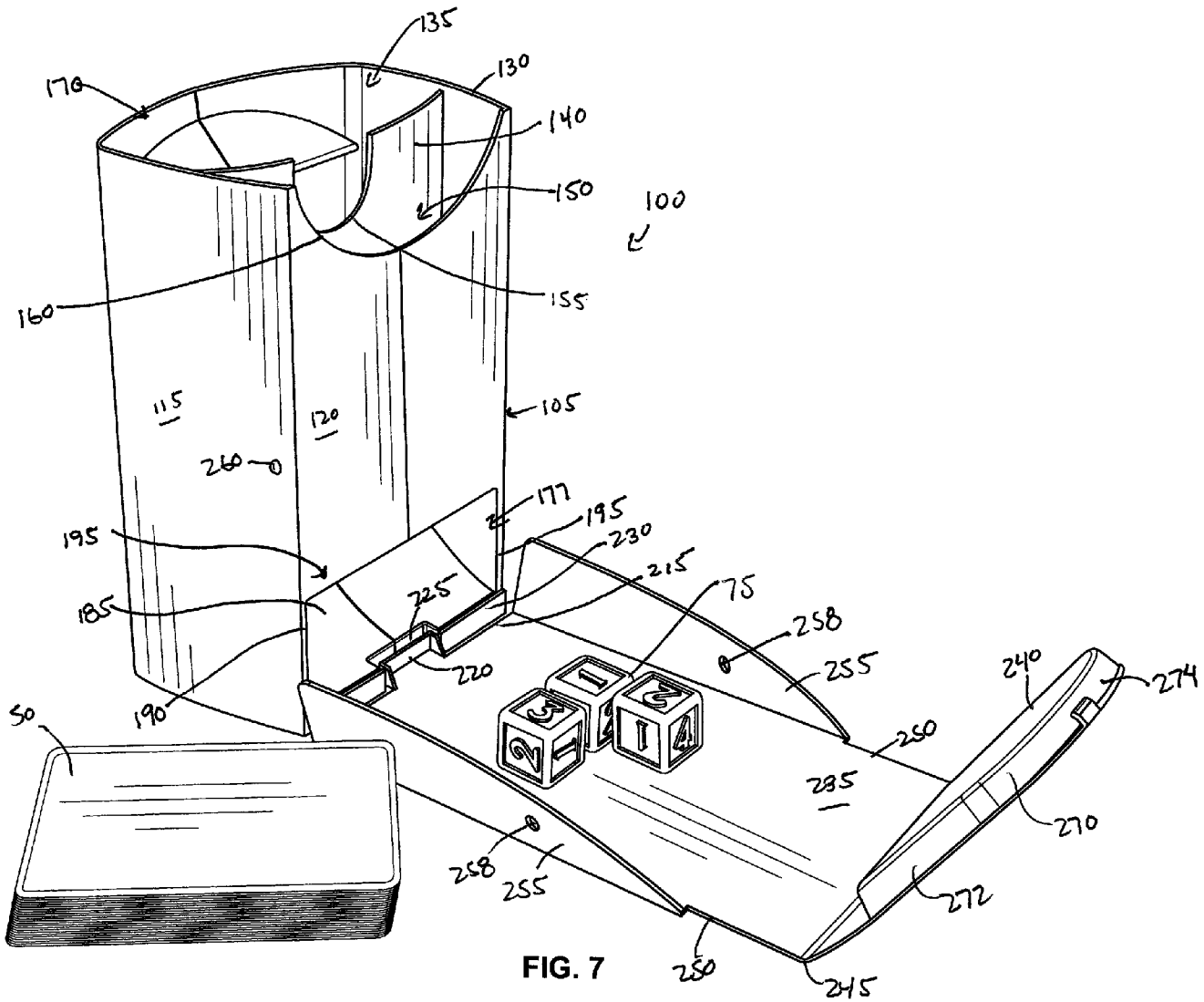
FIG. 7 is a rear perspective view of FIG. 6 illustrating the dice and playing cards at rest.
Figure 8:
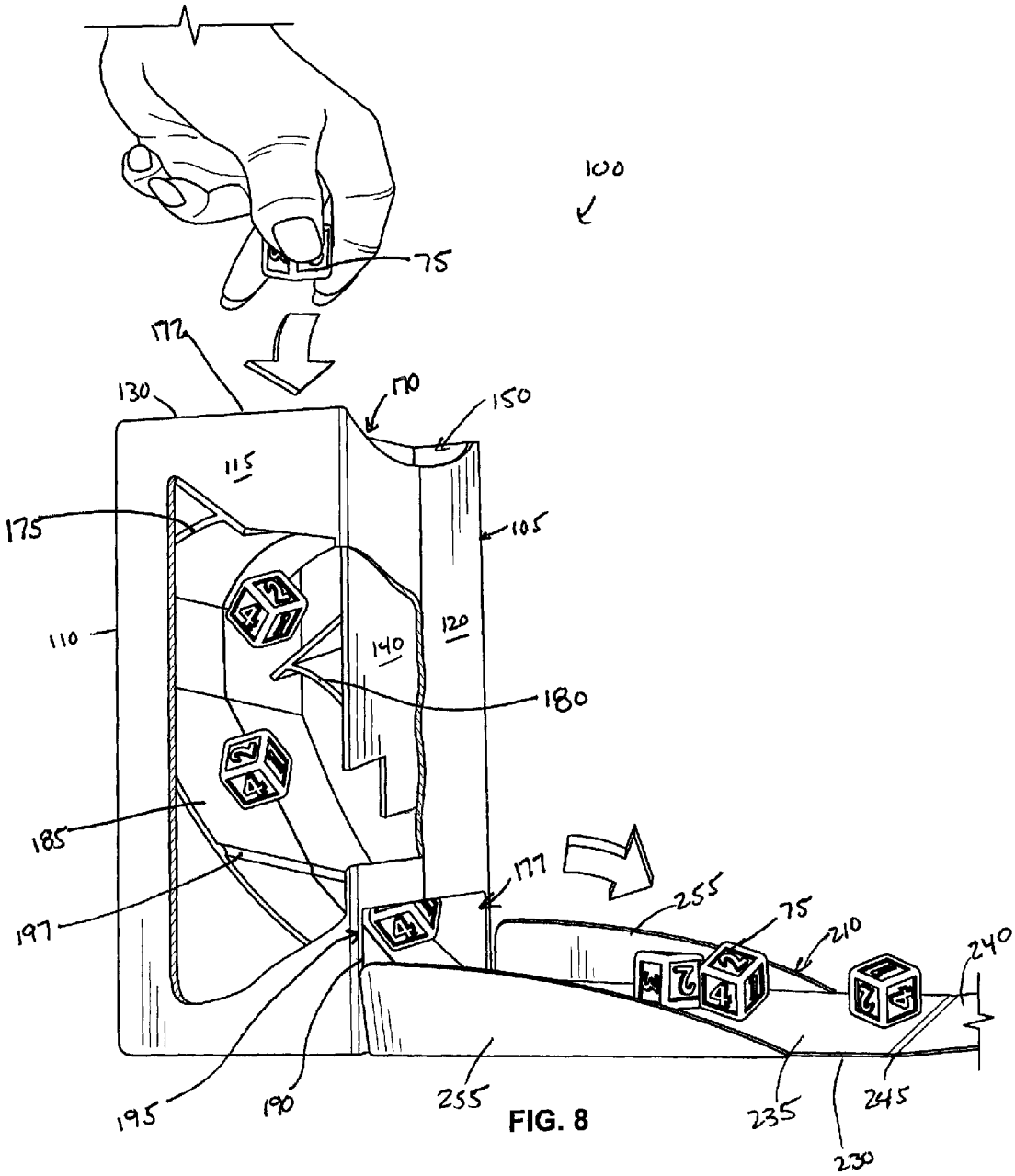
FIG. 8 is side perspective view of FIG. 5 partially showing a section of the inside of the device.
Figure 9:
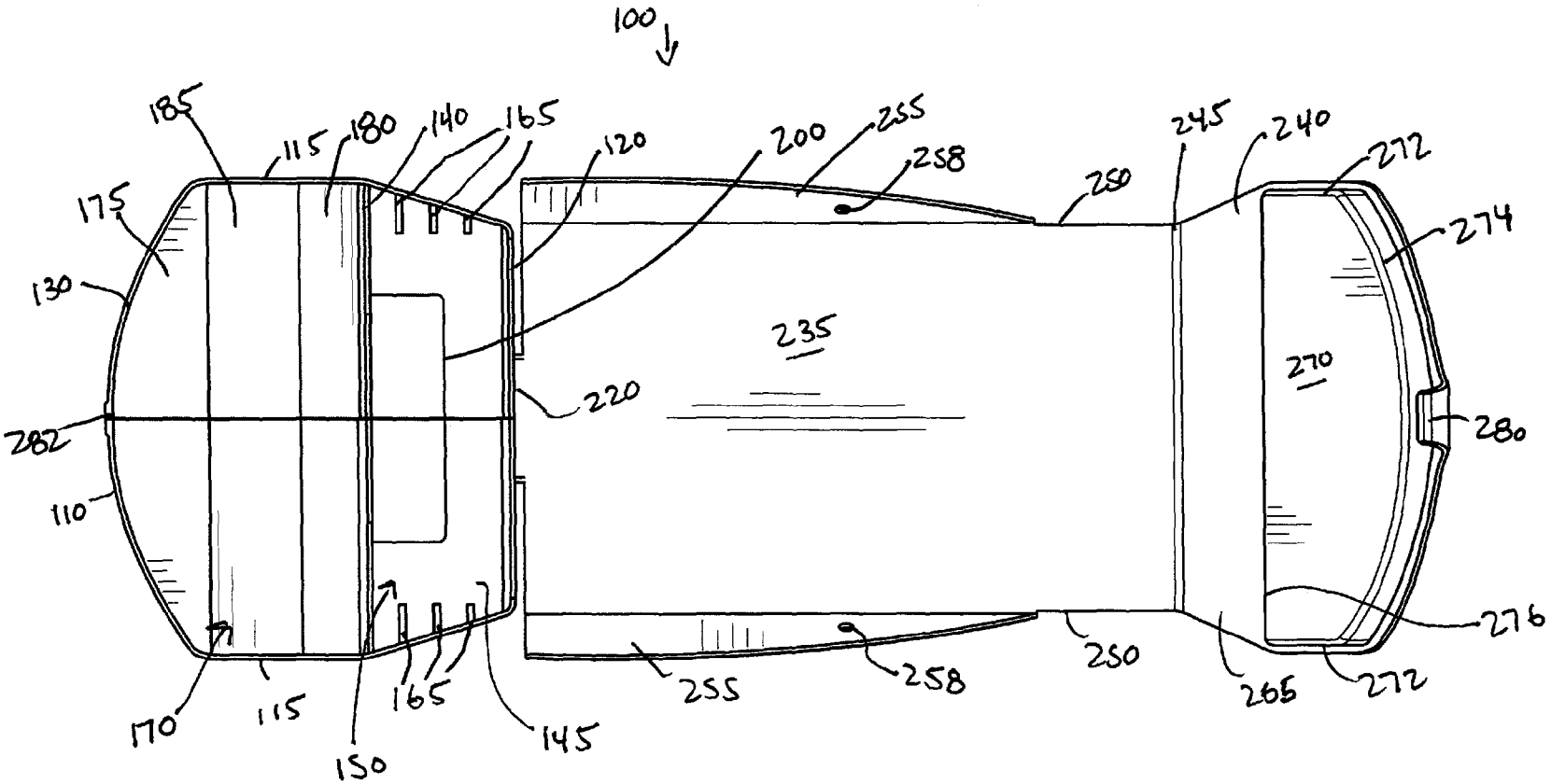
FIG. 9 is a top view of FIG. 5.
Figure 10:
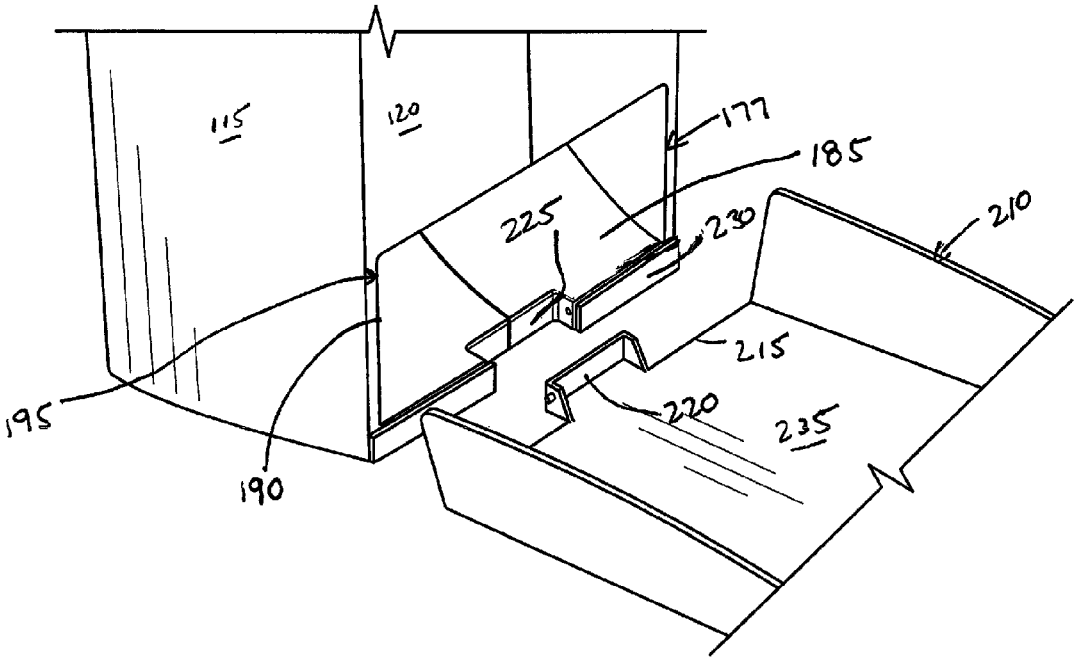
FIG. 10 is an enlarged view of the hinged attachment between the rear and back panels.

Referring to FIGS. 1 through 12, there is shown a self contained dice tumbler device 100 illustrated in the closed or storage position in FIGS. 1 and 2. The device 100 includes a housing 105 with a front panel 110, a pair of side panels 115, and a back panel 120. A bottom panel 125 is substantially flat to permit the device to sit on a surface. The front, side and back panels terminate at a top edge 130 to define a perimeter of a hollow interior 135.

The hollow interior 135 is separated into at least two compartments by an interior lateral panel 140. The interior panel 140 extends substantially between the two side panels 115 and from the top edge 130 downwardly to a base member 145 (shown in FIGS. 9 and 10). The base member 145 is positioned above the bottom panel 125 of the device 100. One of the two compartments created by the interior panel 140 is a holding compartment 150. The holding compartment 150 is defined as the area between the back panel 120 and the interior panel 140, between the two side panels 115 and above the base member 145. The holding compartment 150 is designed to hold playing cards 50.

To facilitate an easy means to access, grab, and remove of the playing cards 50 from the holding compartment 150 the interior panel 140 may include a notch 155 and the back panel 120 may include a similar notch or as illustrated a larger sloping recessed section 160, which as shown extends downwardly at a taper from the two side panels 115 at the edge 130 to meet about the center of the back panel 120. The depth of the recessed section 160 may only be about ¼ to 1 inch.

To help center and hold the playing cards 50 within the holding compartment 150, ribs 165 may be positioned on either side of the side panels 115 between the interior panel 140 and the back panel 120. The ribs 165 may be triangular in shape, with a back portion positioned against the side panel and a bottom portion positioned against the base member 145.

The second compartment created by the interior panel 140 is a tumbler compartment 170, used to tumble and mix the dice as well as provide an opening 172 for the player to drop the dice 75 into and provide an exit 177 from which the tumbled dice leave or are ejected from the tumbler compartment 170. The tumbler compartment 170 is defined as the area between the interior panel 140 and the front panel 110, between the two side panels 115, and from the edge 130 downwardly. The tumbler compartment 170 includes a first ramp member 175 extending inwardly and downwardly from the front panel 110 towards the interior panel 140. A second ramp member 180 is positioned below the first ramp member 175 and extends from the interior panel 140 outwardly and downwardly towards the front panel 110. Below the second ramp member 180 is a third ramp member 185 that extends from the front panel 110 downwardly and inwardly towards the interior panel 140 and continues below the base member 145 towards and leading to an exit 190 positioned about a lower area 195 defined in the back panel 120. The third ramp member 185 may include a raised protrusion 197 traversing the third ramp member 185 from one side panel 115 to the other side panel 115. The raised protrusion 197 aids to provide another means to tumble the dice 75.

The holding compartment 150 may further include an aperture 200 in the base member 145 that opens onto a portion of the third ramp member 185 that traverses below the holding compartment 150. This helps ensure that any dice 75 that are dropped into the holding compartment 150 are permitted to exit and tumble with the dice 75 that are dropped through the tumbler compartment 170.

To close off the opening 172 and exit 177 and permit the device 100 to serve as a storage of the dice, playing cards, and other items that may be provided, the tumbler device 100 includes a panel door 210. The panel door 210 includes a bottom edge 215 with a hinge 220 positioned about the bottom edge 215. The hinge 220 mates with a receiving hinge 225 positioned along a bottom section 230 defined on the back panel 120. The panel door 210 includes a rear panel 235 and a top panel 240. The top panel 240 is connected to the rear panel 235 by a living hinge 245. Extending for either side edge 250 of the rear panel 235 are side doors 255. The side doors 255 slide over the side panels 115 and are secured in place by having a notch 258 on the side door 255 and a receiving detent 260 on the side panel 115. In the opened position, the side doors 255 and the rear panel 235 act as a flat surface for the dice 75 exiting the device 100.

In the closed position, an inside surface of the rear panel 235 abuts the outside surface of the back panel 140. The top panel 240 includes an inside surface 265 with a protruding member 270. The protruding member 270 includes opposing side regions 272 and opposing front and back regions 274 and 276 respectively. When in the closed position, the protruding member 270 frictionally fits into the top of the tumbler compartment 170, such that the opposing side regions frictionally engage the side panels 115 and the opposing front and back regions frictionally engage the front panel 110 and the interior panel 140, respectively. The top panel 240 may also include a front latch 280 to secure against an indent 282 on the front panel 110.

Figure 11:
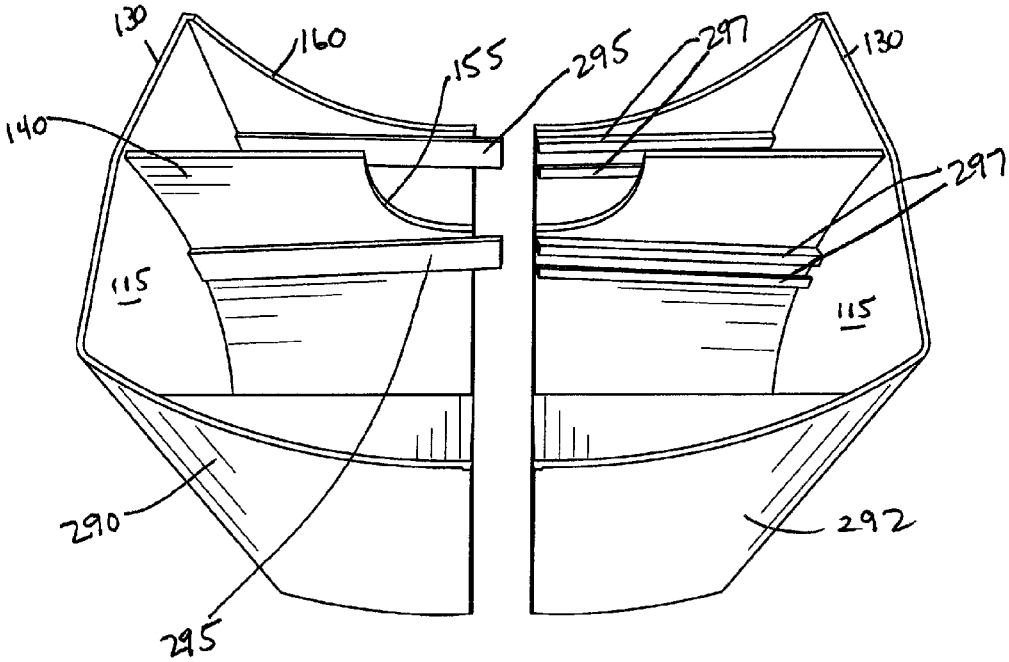
FIG. 11 is a top perspective view of the housing in two pieces to illustrated the assembly of the housing.
Figure 12:
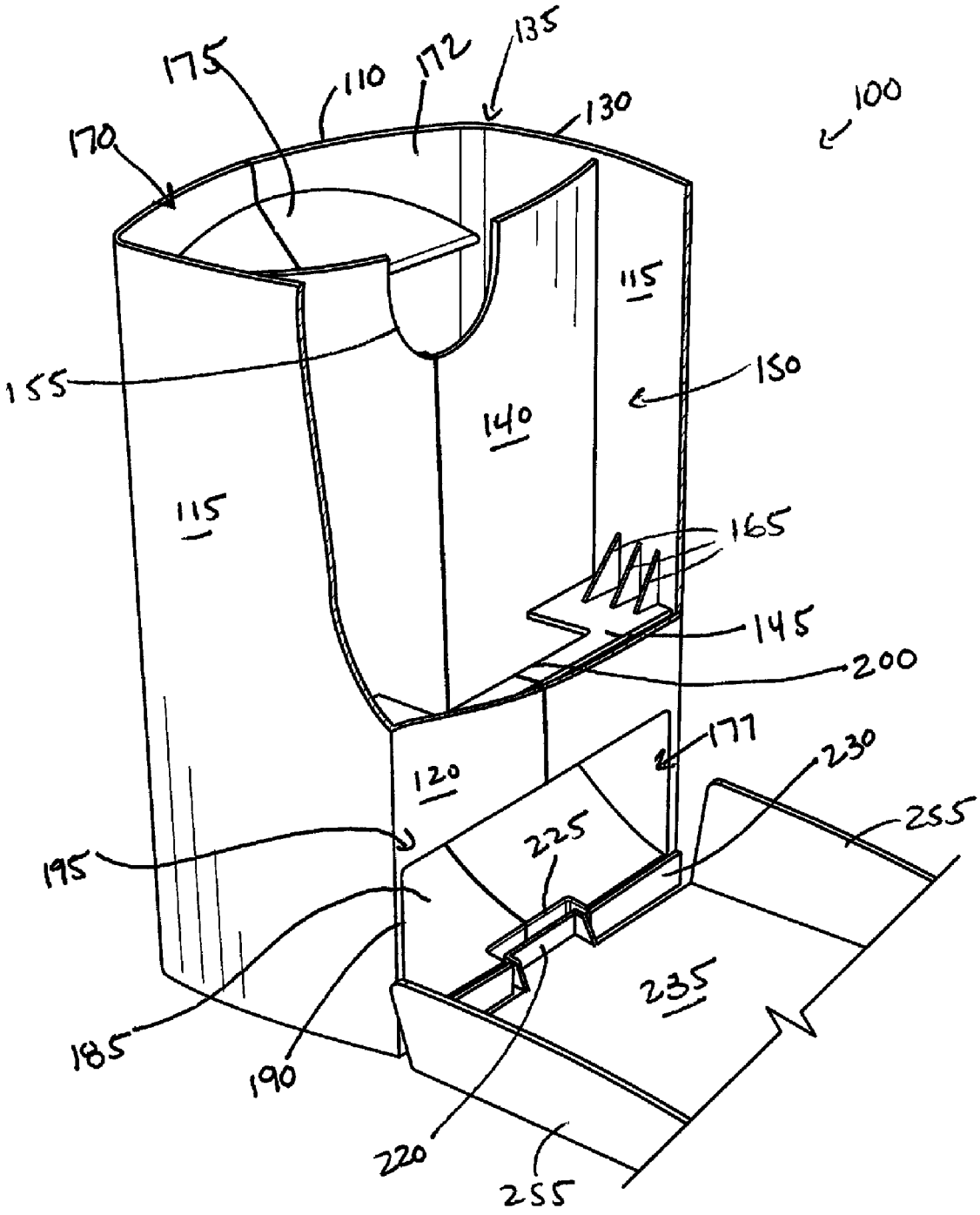
FIG. 12 is a rear perspective view partially showing a section of the inside of the device.

Lastly, as illustrated in FIG. 11, the housing 105 may be a two piece housing 290 and 292 that are secured together. To help align the piece during assembly, one piece may have various lateral extending elements 295 that are positioned or slide between pairs of lateral segments 297 that abut the extending elements 295 when the two piece housing is assembled.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A self contained dice tumbler device comprising:

a housing having a front panel, a pair of side panels, a back panel, and a bottom panel, the front, side, and back panels all terminate at a top edge to define a hollow interior;

an interior lateral panel positioned within the hollow interior between the front and back panel and extending to connect to the pair of side panels, the interior lateral panel terminating at one end about the top edge and terminating at a bottom edge with a base member that is positioned above the bottom panel, wherein a holding compartment is defined between the back panel and the interior panel, between the two side panels, and above the base member to the top edge and wherein a tumbler compartment is defined between the front panel and the interior panel and between the two side panels;

the tumbler compartment being opened about the top edge to provide access to the hollow interior, the tumbler compartment further includes a lower ramp member extending from the front panel downwardly towards the back panel and extending below the base member to an exit opening positioned along a lower area defined in the back panel; and a panel door having a rear panel and a top panel, the rear panel being hingedly attached to a bottom edge of the back panel below the exit opening and the real panel being hingedly attached to the top panel, the panel door when in a closed position positions the real panel against the back panel and positions the top panel against the top edge of the housing.

2. The self contained dice tumbler device of claim 1, wherein the rear panel further includes side doors extending from either side edge of the rear panel, and wherein when the panel door is in the closed position, the side doors position against a portion of the side panels.

3. The self contained dice tumbler device of claim 2, wherein each of the side doors include a notch corresponding to a detent on the side panels.

4. The self contained dice tumbler device of claim 1, wherein the base member further includes an aperture opening onto a portion of the lower ramp member that traverses below the holding compartment.

5. The self contained dice tumbler device of claim 1, wherein the tumbler compartment further includes an upper ramp member above the lower ramp member, the upper ramp member extending downwardly and away from the front panel towards the interior panel, and the upper ramp member terminating at an edge positioned between the front panel and the interior panel.

6. The self contained dice tumbler device of claim 5, wherein the tumbler compartment further includes a middle ramp member positioned between the first ramp member and the lower ramp member, the middle ramp member extending downwardly and away from the interior panel towards the front panel, and the middle ramp member terminating at an edge positioned between the interior panel and the front panel.

7. The self contained dice tumbler device of claim 1 further comprising playing cards positioned in the holding compartment.

8. The self contained dice tumbler device of claim 1, wherein the lower ramp member includes a raised protrusion traversing the lower ramp member from one side panel to the other side panel.

9. The self contained dice tumbler device of claim 1, wherein the interior panel includes a notch and the back panel includes sloping recessed section extending downwardly at a taper from the two side panels, whereby the playing cards positioned in the holding compartment are accessible.

10. The self contained dice tumbler device of claim 1 further comprising ribs positioned on each of the pair of side panels between the interior panel and the back panel, each rib having a back portion positioned against one of the side panels and having a bottom portion positioned against the base member.

11. The self contained dice tumbler device of claim 1, wherein the top panel of the panel door includes an inside surface with a protruding member having a defined profile that includes opposing side regions and opposing front and back regions that when the panel door is in the closed position, the protruding member frictionally fits into a top portion of the tumbler compartment.

12. The self contained dice tumbler device of claim 1, wherein the housing further is defined as a two piece housing, wherein one of the two piece housing includes various lateral extending elements that are positioned between pairs of lateral segments on the other one of the two piece housing that abut the extending elements when the two piece housing is assembled.

13. A self contained dice tumbler device comprising:

a housing defining a hollow interior and a top entry opening and an interior lateral panel positioned within the hollow interior to separate the hollow interior into a tumbler compartment and a holding compartment, the holding compartment having a defined bottom base member, and the tumbler compartment includes a lower ramp member extending below the bottom base member of the holding compartment to an exit opening positioned along a lower area in the housing, the bottom base member further including an aperture opening onto a portion of the lower ramp, and a panel door having a rear panel and a top panel, the rear panel being hingedly attached to a bottom edge of the lower area in the housing below the exit opening and the real panel being hingedly attached to the top panel, the panel door when in a closed position positions the real panel against a side of the housing sealing the exit opening and positions the top panel against the top entry opening of the housing.

14. The self contained dice tumbler device of claim 13, wherein the rear panel further includes side doors extending from either side edge of the rear panel, and wherein when the panel door is in the closed position, the side doors position against a portion of the housing and wherein each of the side doors include a notch corresponding to a detent positioned on said portion of the housing.

15. The self contained dice tumbler device of claim 13, wherein the tumbler compartment further includes an upper ramp member above the lower ramp member, the upper ramp member extending downwardly and away from an inside wall defined by the housing opposite the interior panel towards the interior panel, and the upper ramp member terminating at an edge positioned between the inside wall of the housing and the interior panel.

16. The self contained dice tumbler device of claim 15, wherein the tumbler compartment further includes a middle ramp member positioned between the first ramp member and the lower ramp member, the middle ramp member extending downwardly and away from the interior panel towards the inside wall of the housing, and the middle ramp member terminating at an edge positioned between the interior panel and the inside wall of the housing.

17. The self contained dice tumbler device of claim 13 further comprising playing cards positioned in the holding compartment.

* * * * *